US005642937A

United States Patent [19]

Kuan

[11] Patent Number: 5,642,937

[45] Date of Patent: Jul. 1, 1997

[54] PRESSURE-DIFFERENTIAL LIQUID STIRRER

[76] Inventor: Ching Fu Kuan, No. 12, Alley 18, Lane 136, Er Jiu Road., Ta Pu Lee, San Hsia, Taipei Hsien, Taiwan

[21] Appl. No.: 636,521

[22] Filed: Apr. 23, 1996

[51] Int. Cl.[6] ..... B01F 13/02

[52] U.S. Cl. ..... 366/106; 366/341

[58] Field of Search ..... 366/10, 101, 106, 366/107, 191, 341, 342, 349

[56] References Cited

U.S. PATENT DOCUMENTS

| | | | |
|---|---|---|---|
| 1,123,542 | 1/1915 | Janensch | 366/101 |
| 2,504,009 | 4/1950 | De Phillips et al. | 366/101 |
| 2,917,386 | 12/1959 | Jones et al. | 366/101 X |
| 3,450,389 | 6/1969 | McCurdy | 366/106 |
| 3,544,074 | 12/1970 | Karpacheva et al. | 366/106 |

FOREIGN PATENT DOCUMENTS

| | | | |
|---|---|---|---|
| 2054487 | 4/1971 | France | 366/106 |
| 1101287 | 7/1984 | U.S.S.R. | 366/341 |
| 996195 | 6/1965 | United Kingdom | 366/106 |

*Primary Examiner*—Charles E. Cooley
*Attorney, Agent, or Firm*—Bacon & Thomas

[57] ABSTRACT

A pressure-differential liquid stirrer which includes a liquid tank which holds the liquid to be stirred, the liquid tank having a top opening, a bottom wall, and a sealing cover covered on the top opening, the sealing cover having a hole; a single-outlet tube vertically disposed inside the liquid tank, having a bottom opening facing the bottom wall of the liquid tank and spaced from it by a gap for permitting the liquid to flow between the liquid tank and the single-outlet tube; an air pipe having one end inserted through the hole of the sealing cover into the inside of the liquid tank, and an opposite end coupled to an air control device; and an air control device coupled to the air pipe and controlled to force compressed air into the liquid tank and to release air out of the liquid tank so as to force the liquid to be stirred.

6 Claims, 3 Drawing Sheets

PRESSURE-DIFFERENTIAL LIQUID STIRRER

BACKGROUND OF THE INVENTION

The present invention relates to liquid stirrers, and relates more particularly to a pressure-differential liquid stirrer which stirs up the liquid by continuously driving compressed air into the liquid tank and then releasing compressed air from the liquid tank.

Various liquid stirrers have been developed for use in chemical, dyestuff, and food industries to stir different liquids. These stirrers commonly use magnetic force, propelling force, or bubbles to stir liquids. FIG. 1 shows a conventional magnetic stirrer which comprises a liquid tank, a magnetic stirring stick placed inside the liquid tank, a motor disposed below the liquid tank, and a magnet coupled to the output shaft of the motor and turned to move the magnetic rod in the liquid tank. This structure of liquid stirrer is not suitable for a high speed stirring operation, therefore it is commonly used in stirring liquids of low viscosity. If the magnetic stirring stick or the magnet loses its magnetic force, the stirring work becomes unable to be achieved. FIG. 2 shows the structure of a conventional propeller stirrer which comprises a liquid tank, a motor suspended from a support outside the liquid tank, and a propeller disposed inside the liquid tank and turned by the motor to stir the liquid. The main drawback of this structure of liquid stirrer is its complicated procedure of replacing the liquid. Furthermore, this structure of liquid stirrer is not practical for an enclosed stirring operation. FIG. 3 shows the structure of a conventional bubble stirrer which comprises a liquid tank, an air pipe having one end inserted into the inside of the liquid tank and an opposite end connected to an air compressor. When compressed air is driven from the air compressor into the liquid tank through the air pipe, bubbles are produced in the liquid inside the liquid tank, thereby causing the liquid to be stirred. This structure of liquid stirrer is simple in structure and less expensive. However, because bubbles are produced in the liquid, the quality of the liquid may be affected.

SUMMARY OF THE INVENTION

The present invention provides a pressure-differential liquid stirrer which eliminates the aforesaid drawbacks. According to one embodiment of the present invention, the pressure-differential liquid stirrer comprises a liquid tank which holds the liquid to be stirred, the liquid tank having a top opening, a bottom wall, and a sealing cover covered on the top opening, the sealing cover having a hole; a single-outlet tube vertically disposed inside the liquid tank, having a bottom opening facing the bottom wall of the liquid tank and spaced from it by a gap for permitting the liquid to flow between the liquid tank and the single-outlet tube; an air pipe having one end inserted through the hole of the sealing cover into the inside of the liquid tank, and an opposite end coupled to an air control device; and an air control device coupled to the air pipe and controlled to force compressed air into the liquid tank and to release air out of the liquid tank so as to force the liquid to be stirred.

DETAILED DESCRIPTION OF THE PREFERRED EMBODIMENT

Figure 4:
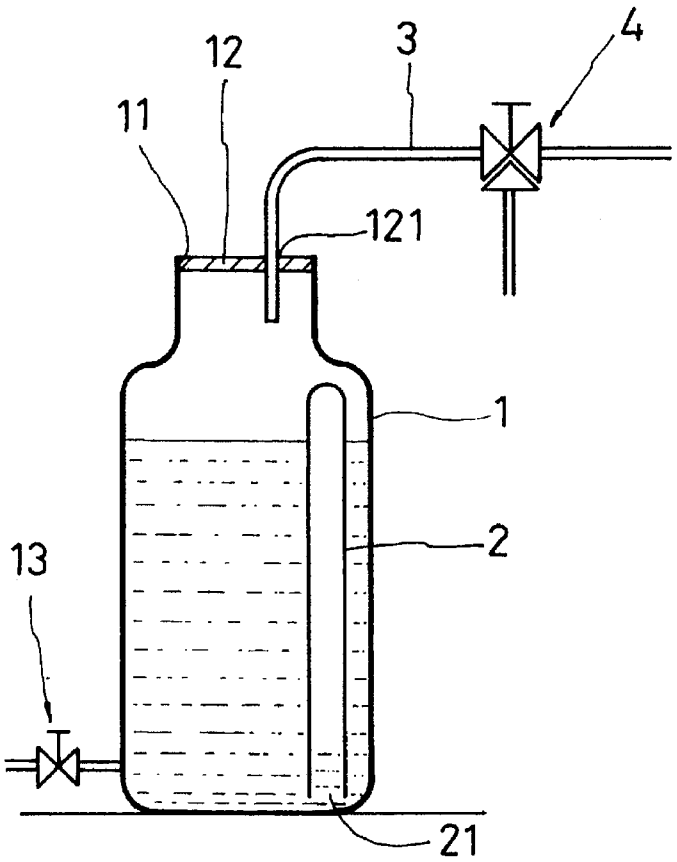
FIG. 4 is a side view of the present invention showing the structure of the pressure-differential liquid stirrer thereof.

Referring to FIG. 4, a pressure-differential liquid stirrer in accordance with the present invention is generally comprised of a liquid tank 1, a single-outlet tube 2, an air pipe 3, and an air control device 4. The liquid tank 1 is a hollow barrel having a top opening 11, a sealing cover 12 covered on the top opening 11, and a drain valve 13 at the bottom for drainage control. The sealing cover 12 has a hole 121 through which the air pipe 3 is inserted into the inside of the liquid tank 1. The single-outlet tube 2 is vertically mounted inside the liquid tank 1, having an opening 21 at one end disposed at the bottom and spaced from the bottom wall of the liquid tank 1 by a gap. The air pipe 3 has one end inserted through the hole 121 of the sealing cover 12 into the inside of the liquid tank 1, and an opposite end coupled to the air control device 4. The air control device 4 is a three-way solenoid valve coupled between the air pipe 3 and a high pressure air source for example an air compressor, and controlled by electrical signals. By means of controlling the operation of the air control device 4, compressed air can be driven into the liquid tank 1, and exhaust gas can be drawn away from the liquid tank 1.

Figure 1:
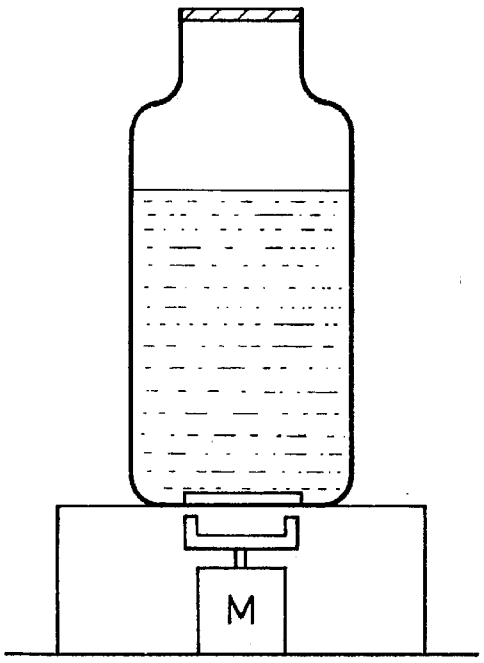
(PRIOR ART) FIG.1
FIG. 1 shows the structure of a conventional magnetic stirrer.
Figure 2:
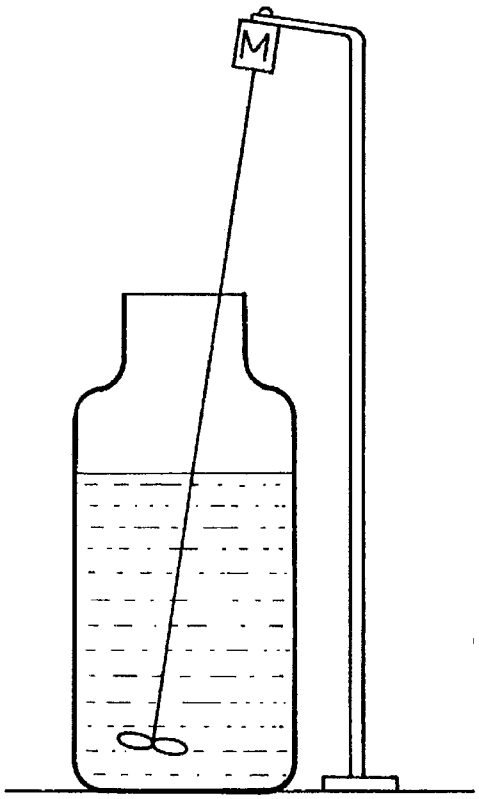
(PRIOR ART) FIG.2
FIG. 2 shows the structure of a conventional propeller stirrer.
Figure 3:
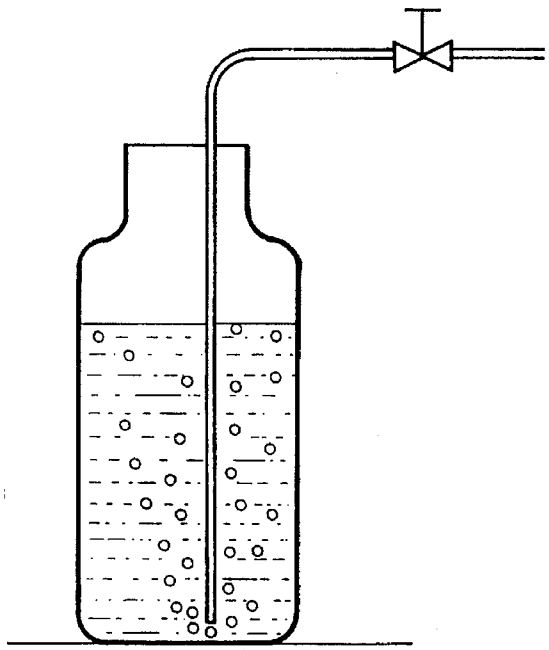
(PRIOR ART) FIG.3
FIG. 3 shows the structure of a conventional bubble stirrer.
Figure 5:
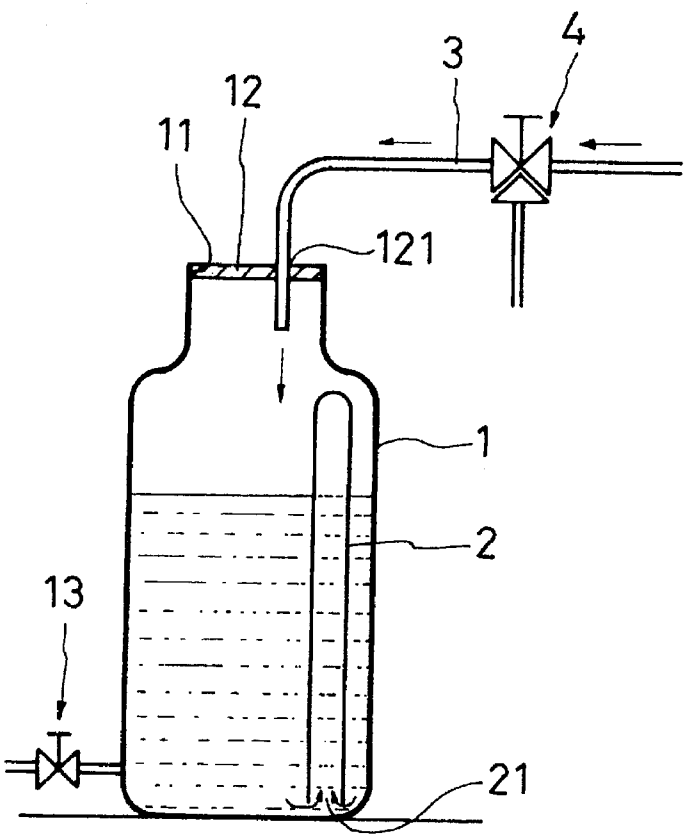
FIG. 5 is an operational view of the present invention, showing compressed air forced into the liquid tank and the liquid forced from the liquid tank into the single-outlet tube.
Figure 6:
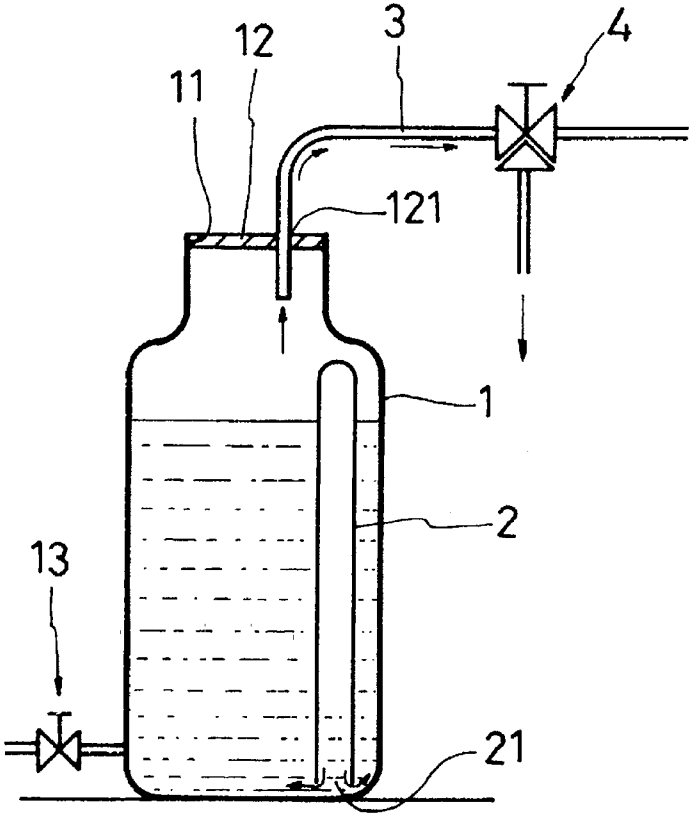
FIG. 6 is another operational view of the present invention, showing compressed air released from the liquid tank and the liquid forced from the single-outlet tube into the liquid tank.

Referring to FIGS. 5 and 6 and FIG. 4 again, when a liquid is filled into the liquid tank 1 at the atmospheric pressure, only a small amount of the liquid passes from the liquid tank 1 to the inside of the single-outlet tube 2. When the sealing cover 12 is fastened to the top opening 11 of the liquid tank 1 and the air pipe 3 is installed in the liquid tank 1, the air control device 4 is driven to let compressed air pass through the air pipe 3 into the inside of the liquid tank 1. When the inside pressure of the liquid tank 1 is gradually increased, the liquid is relatively forced into the inside of the single-outlet tube 2. When the liquid level inside the liquid tank 1 and the liquid level inside the single-outlet tube 2 are maintained at the same value, the inside pressure of the liquid tank 1 and the inside pressure of the single-outlet tube 2 are balanced (see FIG. 5). Then, the air control device 4 is controlled to release the inside pressure of the liquid tank 1 through the air pipe 3. When the inside pressure of the liquid tank 1 is released, the inside pressure of the single-outlet tube 2 immediately forces the liquid out of the single-outlet tube 2 to the inside of the liquid tank 1 until the inside pressure of the single-outlet tube 2 is reduced to the level of the inside pressure of the liquid tank 1. When the liquid is forced out of the single-outlet tube 2 into the liquid tank 1, the liquid in the liquid tank 1 is stirred (see FIG. 6). Therefore, the liquid is fully stirred by repeating the aforesaid procedure. The stirring effect is determined subject to the diameter of the single-outlet tube 2 and the distance between the opening 21 of the single-outlet tube 2 and the bottom wall of the liquid tank 1.

Figure 7:
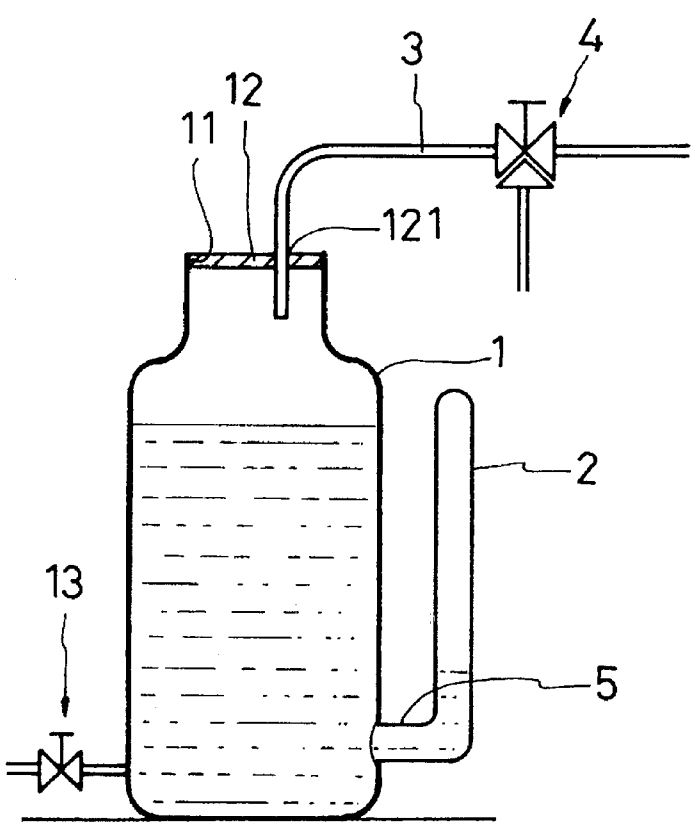
FIG. 7 is a side view of an alternate form of the present invention, showing the single-outlet tube vertically disposed outside the liquid tank and the connecting tube connected between the liquid tank and the bottom open end of the single-outlet tube.

FIG. 7 shows an alternate form of the present invention, in which the single-outlet tube 2 is vertically disposed outside the liquid tank 1 and connected to the lower end of the liquid tank 1 by a connecting tube 5.

It is to be understood that the drawings are designed for purposes of illustration only, and are not intended as a definition of the limits and scope of the invention disclosed.

What the invention disclosed is:

1. A pressure-differential liquid stirrer comprising:

a liquid tank which holds the liquid to be stirred, said liquid tank having a top opening, a bottom wall, and a sealing cover covering said top opening, said sealing cover having a hole;

a single-outlet tube with a single outlet opening vertically disposed inside said liquid tank, the tube having a bottom end forming the single outlet opening facing the bottom wall of said liquid tank and spaced from the bottom wall by a gap for permitting the liquid to flow between said liquid tank and single-outlet tube the tube having a sealed opposite end located below the sealing cover;

an air pipe having one end inserted through the hole of said sealing cover into the inside of said liquid tank and ending above the liquid in the liquid tank, and an opposite end; and an air control device coupled to said opposite end of said air pipe and controlled to force compressed air into said liquid tank and to release air out of said liquid tank so as to force the liquid to be stirred.

2. The pressure-differential liquid stirrer of claim 1 wherein said liquid tank has a drain valve near the bottom wall for drainage of the liquid.

3. The pressure-differential liquid stirrer of claim 1 wherein said air control device is a three-way solenoid valve controlled by electrical signals.

4. A pressure-differential liquid stirrer comprising:

a liquid tank which holds the liquid to be stirred, said liquid tank having a top opening, a bottom wall, and a sealing cover covering said top opening, said sealing cover having a hole;

a single-outlet tube vertically disposed outside said liquid tank, the tube having a bottom open end connected to said liquid tank adjacent to the bottom wall by a connecting tube for permitting the liquid to flow between said liquid tank and said single-outlet tube;

an air pipe having one end inserted through the hole of said sealing cover into the inside of said liquid tank and ending above the liquid in the liquid tank, and an opposite end; and an air control device coupled to said opposite end of said air pipe and controlled to force compressed air into said liquid tank and to release air out of said liquid tank so as to force the liquid to be stirred.

5. The pressure-differential liquid stirrer of claim 4 wherein said liquid tank has a drain valve near the bottom wall for drainage of the liquid.

6. The pressure-differential liquid stirrer of claim 4 wherein said air control device is a three-way solenoid valve controlled by electrical signals.

* * * * *